United States Patent [19]

Tamba et al.

[11] Patent Number: 4,548,167

[45] Date of Patent: Oct. 22, 1985

[54] SUCTION AIR PASSAGE OF INTERNAL COMBUSTION ENGINE

[75] Inventors: Shinichi Tamba, Kakogawa; Masato Sato, Akashi; Kozo Watanabe, Ono; Masanobu Yamashita, Miki, all of Japan

[73] Assignee: Kawasaki Jukogyo Kabushiki Kaisha, Japan

[21] Appl. No.: 645,164

[22] Filed: Aug. 28, 1984

[30] Foreign Application Priority Data

Aug. 31, 1983 [JP] Japan ..... 58-159361

[51] Int. Cl.[4] ..... F02F 1/42

[52] U.S. Cl. ..... 123/41.56; 123/65 VD; 123/179 SE

[58] Field of Search ..... 123/41.31, 41.56, 41.63, 123/41.65, 41.7, 65 VD, 179 SE, 185 A, 185 B, 195 HC, 196 W, 84, 85

[56] References Cited

U.S. PATENT DOCUMENTS 3,118,433 1/1964 Lechtenberg ..... 123/41.31

*Primary Examiner*—Craig R. Feinberg
*Assistant Examiner*—David A. Okonsky

[57] ABSTRACT

A suction air passage of the side-valve type of internal combustion engines is composed of a pipe-shaped portion which is integrated into the cylinder, for example by means of metal mold, and is opened at its outside, and a cover which is fixed to the pipe-shaped portion to close the opening thereof.

3 Claims, 5 Drawing Figures

SUCTION AIR PASSAGE OF INTERNAL COMBUSTION ENGINE

BACKGROUND OF THE INVENTION

This invention relates to suction air passage of internal combustion engines, referring more particularly to the side-valve type of internal combustion engines on which a suction valve and an exhaust valve are located side by side with each other on one side of the cylinder.

As the side-valve type of internal combustion engines is described in the U.S. Pat. No. 3,118,433, the engines can be illustrated as follows.

As shown in FIG. 1, a suction valve 1 and an exhaust valve 2 of the conventional internal combustion engine 4 are located side by side with each other on one side of the cylinder 3, with a silencer 5 placed outside of the exhaust valve 2 and with a carburetor 6 almost diagonally to the silencer 5 on the other side of the cylinder 3.

In connection with the side-valve type of internal combustion engine 4 thus arranged, a suction air passage 7 from the carburetor 6 to the suction valve 1 is a long one which consists of a suction air pipe *7a*, and a joint *7b* and an elbow *7b'* at its both ends. Thus, the configuration needs many connections such as the carburetor 6—the joint *7b*, the joint *7b*—the suction air pipe *7a*, the suction air pipe *7a*—the elbow *7b'*, and the elbow *7b'*—the cylinder 3, resulting in troublesome assembling of many parts, and in short rigidity of the carburetor connection as well as in incomplete air tightness at the foresaid connections. Being curved abruptly at the elbow *7b'*, the suction air passage 7 tends to have rather large air resistance, preventing gas mixture from being drawn smooth. Furthermore when an ignition coil is designed to be installed outside the flywheel, the coil must be located over the suction air passage 7 or at the outside in the axial direction of the crankshaft. If the suction pipe *7a* is isolated from the cylinder for assembly, the crankshaft must be extremely long, because the ignition coil must be located over the isolated suction air pipe. And also the suction air pipe *7a* must be curved or dented to avoid the interference between the ignition coil mounting bosses and the suction air pipe.

SUMMARY OF THE INVENTION

To solve the aforesaid problems gave rise to the present invention.

Thus it can be said that the purpose and object of this invention is to provide a suction air passage for the side-valve type of internal combustion engines which gives a fewer connections and parts as well as air-tighter connections and smoother bends than engines heretofore available, and which enables the length of the crankshaft to be shorter because of the lower location of the ignition coil, when an ignition coil is installed.

In one embodiment of the invention for the aforesaid type or the side-valve type of internal combustion engines, a suction air passage from a carburetor to a suction valve consists of a pipe-shaped portion which is partly curved along the cylinder bore for integration into the cylinder with the curved outside wall opened, and a separate cover which is attached to the open surface of the curved section of the pipe-shaped portion.

In another embodiment of the invention, a suction air passage from a carburetor to a suction valve consists of a pipe-shaped portion which is partly curved along the cylinder bore for integration into the cylinder with the curved outside wall opened, and a separate cover which is secured together with an ignition coil to the open surface of the curved section of the pipe-shaped portion.

Not only the aforesaid construction embodying the invention provides a suction air passage for the side-valve type of internal combustion engines with small passage resistance, smooth suction flow of gas mixture and a cooling effect on the cylinder due to suction flow of gas mixture, but the suction air passage which is made of only two parts, that is, a pipe-shaped portion integrated into the cylinder, and a cover closing the opening of the curved section of the pipe-shaped portion along the cylinder bore also enables the number of assembly parts and connections to be less, their assembly to be simpler, and connection sealing to be tighter.

Integration of the pipe-shaped portion or the main component of the suction air passage into the cylinder enables the pipe-shaped portion to be easily made together with the cylinder by means of metal mould, to be stronger in rigidity at the carburetor connection, and to be simpler in installation of the carburetor as well as permits even a through-bolt type carburetor to be mounted.

In addition, mounting the cover of the suction air passage together with an ignition coil to the pipe-shaped portion solves the problems of increasing numbers of bolts and bosses, narrow passage for cooling air flow, and insufficient cooling of cylinder back surface due to mounting the cover and the ignition coil separately as well as readily allows the narrow space between cover-incorporated ignition coil mounting bosses to be a passage for cylinder cooling air. Since the invention permits the ignition coil to be located substantially close to the cylinder in the axial direction of the crankshaft, the invention greatly contributes to shorten the length of the crankshaft, and thus resulting in smaller internal combustion engines.

BRIEF DESCRIPTION OF THE DRAWINGS

The accompanying drawings illustrate embodiments of the invention.

DETAILED DESCRIPTION OF THE PREFERRED EMBODIMENTS

Figure 1:
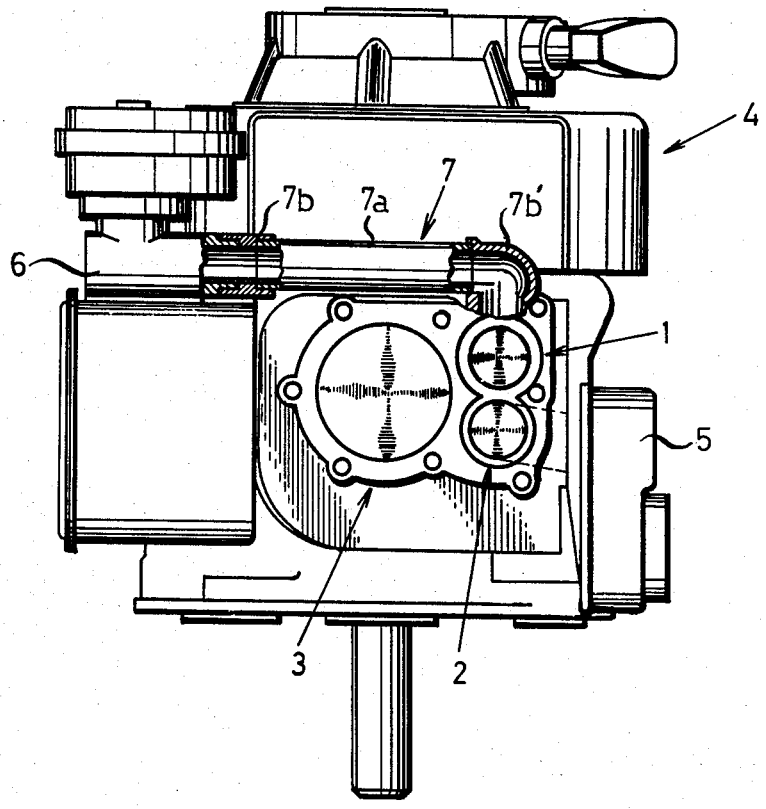
PRIOR ART FIG. 1
FIG. 1 is a plan view with parts broken away which represents the conventional side-valve type of internal combustion engine.
Figure 2:
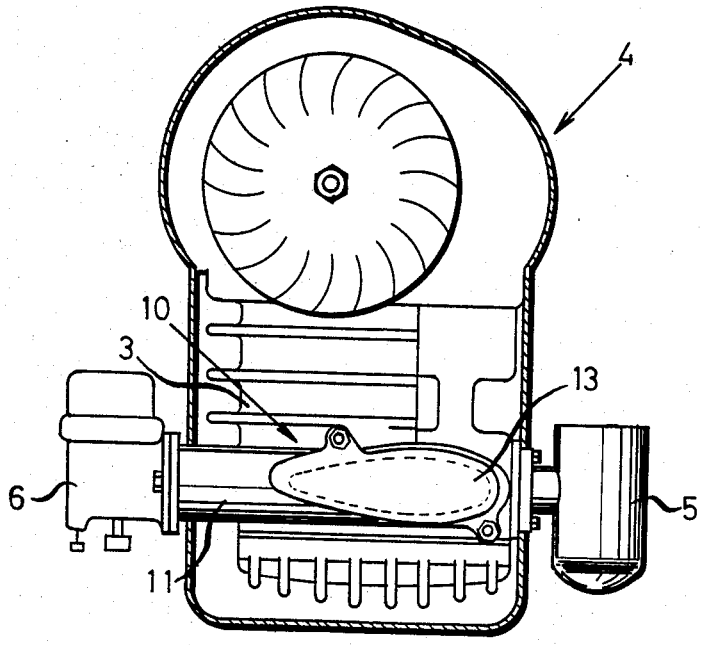
FIG. 2 is a front elevation view with parts broken away of the side-valve type of internal combustion engine equipped with a suction air passage embodying the invention.
Figure 3:
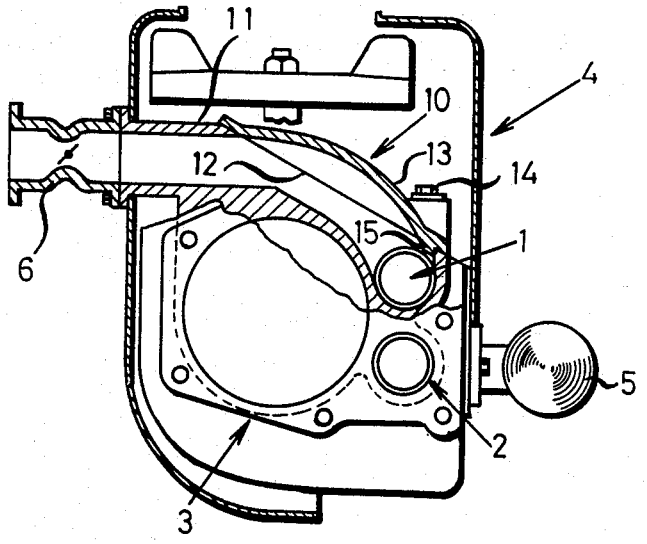
FIG. 3 is a partially sectioned plan of FIG. 2.

In FIGS. 2 and 3, a suction valve 1 and an exhaust valve 2 are arranged side by side with each other on one side of the cylinder 3. A silencer 5 on the side-valve type of an internal combustion engine 4 is locatCed outside of the aforesaid exhaust valve 2, and a carburetor 6 placed almost diagonally to the silencer 5 on the other side of the cylinder 3. The turning portion of a suction air passage 10 embodying the invention from the carburetor 6 to the suction valve 1 is curved along the cylinder bore to form a pipe-shaped portion 11 integrated into the cylinder 3. And the curved outside wall of the pipe-shaped portion 11 is cut diagonally to form an open surface 12 so that a separate cover 13 curved to the shape of the cylinder bore be placed on the open surface 12 to be fastened to the pipe-shaped portion 11 with bolts 14.

As shown in FIG. 3, part of the suction air passage wall of aforesaid cover 13 may be projected beyond its own seal surface or inward from the open surface 12 of the curved section of the pipe-shaped portion 11 so that the projection 15 can sustain the thrust applied on the cover 13 in tightening bolts.

Figure 4:
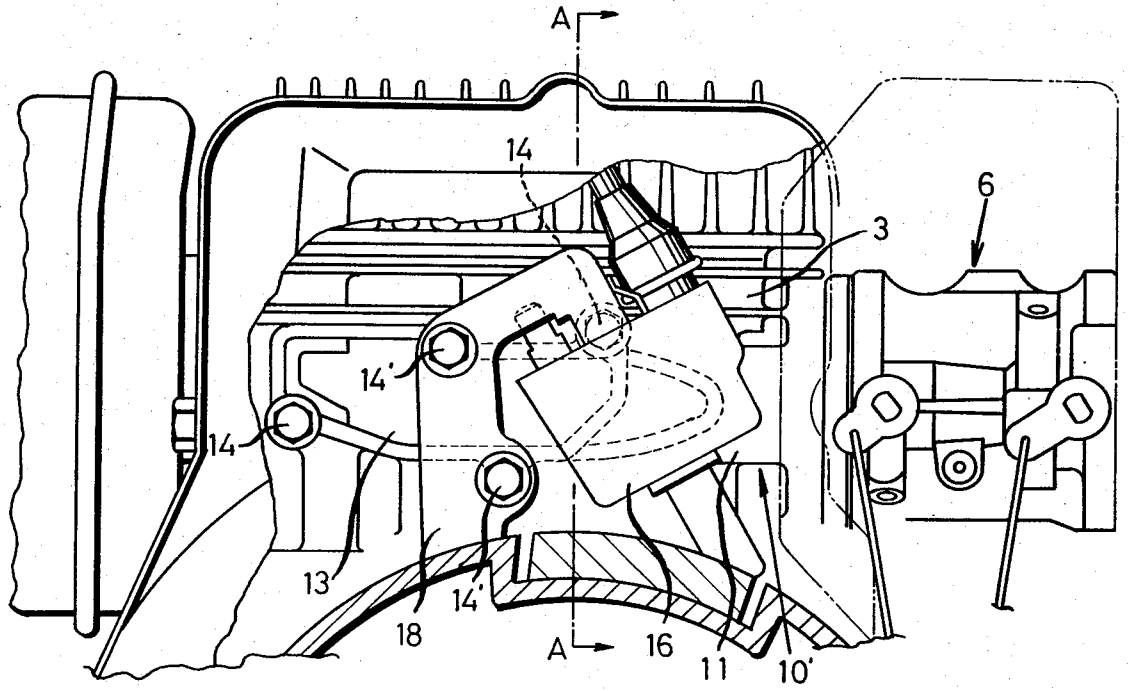
FIG. 4 is a front elevation view with parts broken away of an internal combustion engine equipped with another type of suction air passage embodying the invention.
Figure 5:
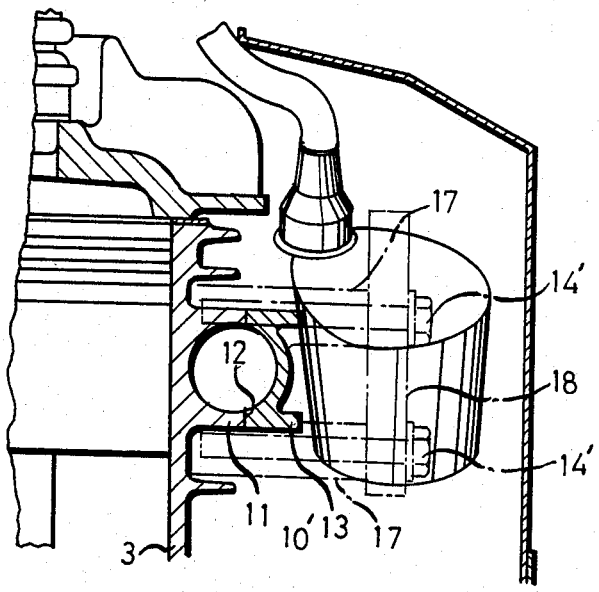
FIG. 5 is an elevation sectioned on the plane of the line A—A in FIG. 4, viewed toward the arrow direction.

A second embodiment of the invention is illustrated in FIGS. 4 and 5. 10' in the figures is a suction air passage from a carburetor 6 to a suction valve (not shown). As with the first embodiment of the invention, the turning portion of a suction air passage 10' is curved along the cylinder bore to form a pipe-shaped portion 11 integrated into the cylinder 3, and the curved outside wall of the pipe-shaped portion 11 is cut diagonally to form an open surface 12 so that a separate cover 13 curved to the shape of the cylinder bore is placed on the open surface 12 to be fixed to the pipe-shaped portion 11 with bolts 14. In addition, an ignition coil 16 is arranged on the outside of the cover 13, where the core 18 of the ignition coil 16 is placed on the coil mounting bosses 17 integrated into the outside surface of the cover 13, and is rigidly secured to the pipe-shaped portion 11 through the coil mounting bosses 17 with bolts 14'. In other words, the cover 13 is bolted to the pipe-shaped portion 11 together with the ignition coil 16.

In another respect, like the first embodiment of the invention, part of aforesaid cover 13 (not shown) may be projected inward beyond the open surface 12 of the curved section of the pipe-shaped portion 11 so that the thrust, with which the cover 13 is confronted on bolting, can be sustained by this projection 15.

Since the turning portion is partly curved along the cylinder bore for smooth shape, the suction air passage 10 or 10' of the internal combustion engines constructed according to the invention provides small passage resistance and smooth suction flow of gas mixture. In corporated into the cylinder 3, the main component of the suction air passage 10 or 10', namely, the pipe-shaped portion 11 enables the cylinder 3 to be cooled by the flow of gas mixture.

What is claimed as my invention is:

1. A suction air passage of the side-valve type of internal combustion engines having a suction valve and an exhaust valve side by side with each other on one side of a cylinder, a silencer outside of said exhaust valve, and a carburetor almost diagonally to the silencer on an opposite side of the cylinder, said suction air passage being characterized by the suction air passage from the carburetor to the suction valve being composed of a pipe-shaped portion which is partly curved along a bore of the cylinder for integration into the cylinder and being opened at a curved outside wall thereof to form an open surface, and a separate cover which is fixed to the open surface of said curved pipe-shaped portion.

2. A suction air passage of the side-valve type of internal combustion engines having a suction valve and an exhaust valve side by side with each other on one side of a cylinder, a silence outside of said exhaust valve, and a carburetor almost diagonally to the silencer on an opposite side of the cylinder, said suction air passage being characterized by the suction air passage from the carburetor to the suction valve being composed of a pipe-shaped portion which is partly curved along a bore of the cylinder for integration into the cylinder and being opened at a curved outside wall thereof to form an open surface, and a separate cover which is fixed together with an ignition coil to the open surface of said curved pipe-shaped portion.

3. The suction air passage of claim 1 or 2, further characterized by said separate cover being partly projected inward beyond a seal surface, that is, the open surface of the curved pipe-shaped portion so that the projection can accomodate the thrust applied on the cover in bolting.

* * * * *